United States Patent [19]

Fontana et al.

[11] 4,168,140

[45] Sep. 18, 1979

[54] APPARATUS FOR PRODUCING A SIMULATED BRICK CONSTRUCTION MEMBER

[76] Inventors: John D. Fontana, 21 Pine Ridge Dr., Smithtown, N.Y. 11787; Louis R. Fontana, 351 Forster Ave., Sayville, N.Y. 11782

[21] Appl. No.: 832,225

[22] Filed: Sep. 12, 1977

Related U.S. Application Data

[63] Continuation-in-part of Ser. No. 694,097, Jun. 9, 1976, abandoned.

[51] Int. Cl.[2] ..... B28B 3/04

[52] U.S. Cl. ..... 425/228; 249/16; 425/414; 425/457

[58] Field of Search ..... 264/293; 249/15, 16; 425/228, 385, 398–400, 414

[56] References Cited

U.S. PATENT DOCUMENTS

| | | | |
|---|---|---|---|
| 2,875,499 | 3/1959 | Ross | 425/414 |
| 3,381,345 | 5/1968 | Williams | 425/398 |
| 3,692,458 | 9/1972 | Kirsch | 425/469 |

FOREIGN PATENT DOCUMENTS

| | | | |
|---|---|---|---|
| 710433 | 6/1954 | United Kingdom | 425/414 |

*Primary Examiner*—John McQuade

*Attorney, Agent, or Firm*—Posnack, Roberts, Cohen & Spiecens

[57] ABSTRACT

For convenience in handling, etc., use is made of a concrete or similarly fabricated member which, although actually a single rectangular block-like member, has a surface line impression effectively simulating a selected arrangement of plural individual pavers or bricks, thereby giving the desirable impression that the construction is formed by said individual bricks, rather than by the fewer number of construction blocks. In accordance with the present invention, the line-forming means, which simulates the individual bricks, is retracted from its position impressed into the concrete mass or mixture through slots in a press-plate having wiping surfaces which removes any adhering concrete therefrom, and thus the shaping contour of said line-forming means is properly preserved for succeeding brick-simulating service. The term "brick" as used herein is intended to broadly encompass regular as well as irregular shapes, such as stones.

2 Claims, 6 Drawing Figures

APPARATUS FOR PRODUCING A SIMULATED BRICK CONSTRUCTION MEMBER

This application is a continuation-in-part of copending application Ser. No. 694,097, filed on June 9, 1976 now abandoned.

BACKGROUND OF THE INVENTION

The present invention relates generally to building or construction blocks, and more particularly to improvements in applying surface lines in these blocks or members which are used to provide a simulated appearance of being formed of individual bricks or the like.

For obvious convenience in handling and the like, large rectangular construction members, fabricated of a suitable concrete mixture, are preferrably used in constructing a "brick" patio or walkway, rather than the more numerous smaller-sized bricks. The desirable "brick" appearance is, nevertheless, achieved by imprinting the surface of the construction member with lines delineating brick-size areas and shapes.

According to present practice and techniques, between succeeding impressions, the line-forming means, consisting essentially of depending projections, must be cleaned of adhering concrete in a time-consuming and tedious procedure, otherwise the adhering concrete adversely changes the shaping contour of these depending projections and correspondingly results in indistinct brick-simulating lines.

Broadly, it is an object of the present invention to provide an improved apparatus for molding concrete construction members of the type having brick-simulating markings which overcomes the foregoing and other shortcomings of the prior art. Specifically, in the operation of the within improved apparatus for producing imprinted concrete construction members the imprinting member is automatically maintained clear of adhering concrete and thus retains its necessary shaping contour throughout succeeding cyclical operation.

An improved concrete construction member-producing apparatus demonstrating objects and advantages of the present invention includes, a press-plate member mounted immediately above the concrete mixture in the path of movement of an imprinting member, said press-plate having line-like openings therein for the projection therethrough of the line-forming means of the imprinter during movement thereof toward and, thus, into the concrete mixture. Each line-like opening is bounded by spaced apart walls having edges therealong which are effective to wipe adhering concrete from each line-forming means during its retraction through the press-plate and away from the concrete mixture. As a consequence, the shaping contour of each line-forming means is maintained for subsequent imprinting service.

The above brief description, as well as further objects, features and advantages of the present invention, will be more fully appreciated by reference to the following detailed description of a presently preferred, but nonetheless illustrative, embodiment in accordance with the present invention when taken in conjunction with the accompanying drawings.

BRIEF DESCRIPTION OF THE DRAWINGS

FIG. 1 is a perspective view of a concrete construction member produced with the improved apparatus hereof, said member being characterized by surface lines simulating an arrangement of individual bricks or the like;

FIG. 3 is a plan view of the press-plate member of the apparatus, in section along line 3—3 of FIG. 5;

FIG. 4 is a side elevational view illustrating not only said press-plate member of FIG. 3, but additional cooperating members forming the apparatus hereof; and FIG. 5 is similarly a side elevational view more particularly illustrating the molding sequence of the apparatus.

DESCRIPTION OF THE PREFERRED EMBODIMENT

Figure 1:
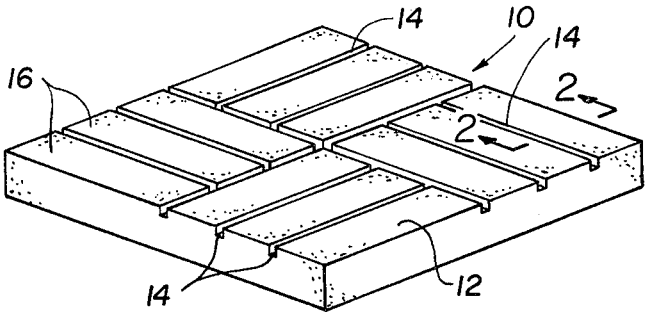
Figure 2A:
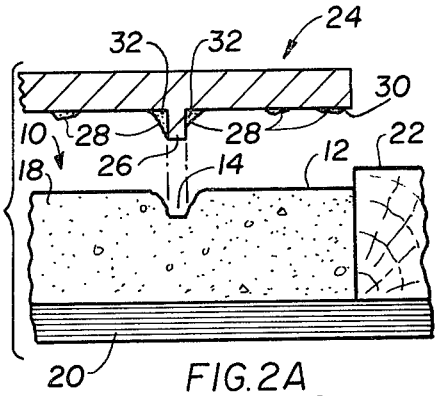
FIG.2A PRIOR ART
FIG. 2A is similarly a partial side elevational view, but is illustrative of a prior art construction member, and illustrates the prior art technique of imprinting a brick-simulating line in a concrete construction member.
Figure 2:
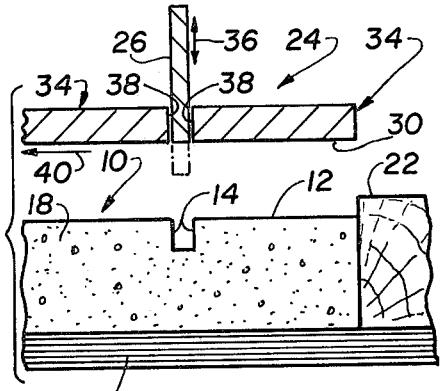
FIG. 2 is a partial side elevational view, in section taken along line 2—2 of FIG. 1, with additional illustrative structure, which significantly illustrates the manner in which a brick-simulating line is imprinted in the surface of the construction member hereof in accordance with the present invention.

Reference is now made to the drawings, and in particular to FIGS. 1, 2 and 2A, which illustrate the product produced by the improved apparatus hereof, and also the improvement possessed by the apparatus hereof which enables its production of such product. Specifically, illustrated in FIG. 1 is a construction member 10, useful in the construction of driveways, walkways, patios, etc., which is formed from a concrete mixture which prior to curing has imprinted in its upper surface 12 an arrangement of lines, individually and collectively designated 14, which effectively simulate individual pavers or bricks, individually and collectively designated 16. The obvious advantage of using the construction member 10 is that when set in place in a patio or the like, it gives the impression of consisting of twelve individual bricks 16 when, in fact, it is only a single construction member, the brick appearance being simulated by the lines 14.

As is perhaps best illustrated in FIG. 2A, in prior art attempts to produce an equivalent construction member 10, the moldable concrete mixture 18 is placed on a support 20 within a rectangular mold box 22 and a typical prior art imprinting member, generally designated 24 in FIG. 2A, is then depressed into the surface 12 of the concrete mass 18. Then, as best illustrated in FIG. 2A, the imprinting member 24, including a depending line-forming projection 26 which was impressed into surface 12 with the objective of forming the previously noted brick-simulating lines 14 therein is withdrawn or retracted. However, almost invariably upon the removal of the line-forming projection 26 from the concrete mass 18, there is an adhering deposit 28 of the concrete mixture in a corner formed by the walls of the projection 26 and the flat surface 30 of member 24, as at 32. As can be readily appreciated, upon the curing of the adhering deposits 28, they remain in the locations 32 and thus change the shaping contour of the line-forming means or projection 26. The result is that the brick-simulating lines 14 are not formed by distinct and straight lines, thereby detracting from the appearance of the construction block 10. In prior art practice, it is therefore required to remove any adhering deposits 28 between successive uses of the imprinting member 24. More often than not, however, not all of the adhering deposits 28 are removed because of their location in the difficult to reach corners or recesses 32, to which there is only limited access because the depending members 26 prevent or interfere with a horizontal wiping stroke, which stroke would be most ideal in removing the deposits 28.

As will be explained more fully hereinafter, the conventional molding machine, such as a "Fleming Patio King", manufactured by the Fleming Corp., Cuba, Mo., utilizes a squeegee 61 to wipe the imprinting member 24.

In sharp contrast to the prior art practice illustrated in FIG. 2A, it is proposed in accordance with the present invention to eliminate the possibility of adverse modification to the shaping contour of the line-forming means of the molding apparatus. Specifically, as illustrated in FIG. 2, in which similar parts are identified by similar reference numerals, the concrete mixture mass or body 18 of the construction member 10 is similarly placed on a support 20 within a molding box 22. In accordance with the present invention, the previously noted imprinting member 24 is not a single or unitary structure, but rather is comprised of two members. One of these members, press-plate 34, also provides a wiping function, which will soon be readily understood as the description proceeds. The other member 26 is, as clearly illustrated in FIG. 2, an elongated version of the previously noted depending projection which forms the brick-simulating lines 14 in the concrete mass 18. It will be further understood that the improved member 26 illustrated in FIG. 2 is appropriately mounted for reciprocating ascending and descending vertical movement 36 relative to the press-plate member 34. As a consequence, walls 38 of the press-plate member 34 occupy a strategic adjacent position in the path of movement 36 of the line-forming means or member 26 and thus during retracting movement thereof, as illustrated by the phantom and full perspectives of members 26 and 32, any adhering deposits 28 on the lower end of member 26 are wiped off of this member. The deposits 28 will be retained in the concrete mass 18 by the flat undersurface 30 of press-plate 34, since it will be understood that curing thereof has not yet been achieved. However, in this instance the deposits 28 are very readily wiped clear of the surface 30 with a horizontal wiping stroke 40 which may be performed manually between molding operations. The ease with which wiping 40 of the surface 30 is accomplished should be obvious and is due in large part to the fact that each line-forming projection 26 is retracted clear of the surface 30 and thus does not interfere with movement horizontally across the surface 30.

From the foregoing description it should be readily appreciated that the inventive contribution hereof, which has just been described in connection with FIG. 2, may be embodied in an appropriate apparatus for molding a construction member 10 in any one of a number of ways. Thus, the invention is not restricted to any one specific way, but contemplates all equivalent alternatives. However, for completeness sake, one exemplary way of embodying the improved imprinting member 24 of FIG. 2 into a suitable molding apparatus will be explained in connection with the molding apparatus illustrated in FIGS. 3, 4 and 5.

Figure 4:
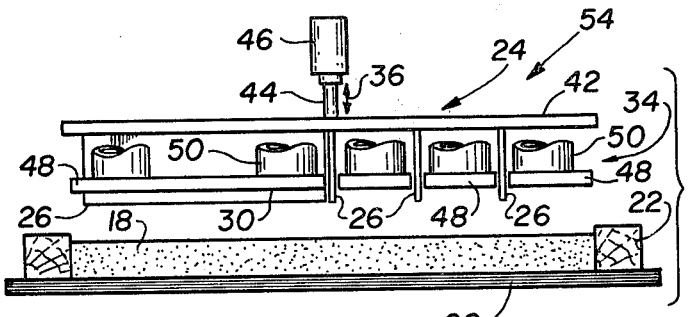

As illustrated in FIG. 4, the imprinting member 24 includes a common panel support 42 for the line-forming means thereof consisting of the previously noted depending projections 26. The vertical reciprocating movement 36 is achieved by connection of the panel 42 to a piston 44 of a pressure air cylinder 46.

Figure 3:
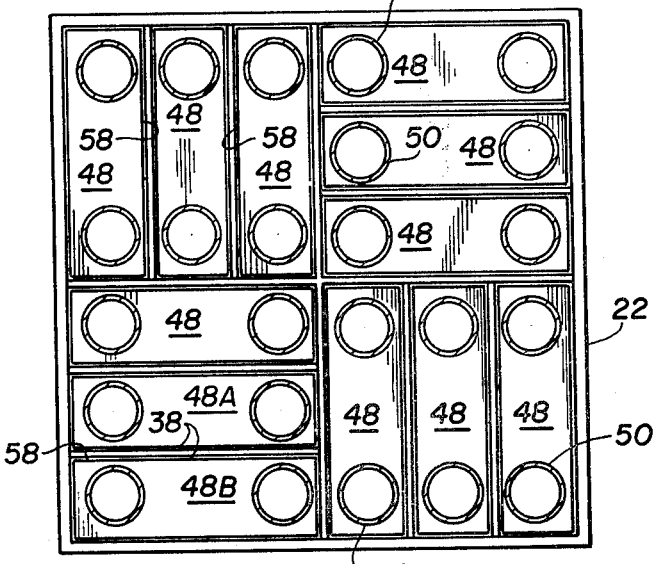
FIGS. 3, 4 and 5 illustrate an apparatus for producing concrete construction members utilizing the improved technique of FIG. 2. Specifically.

The other cooperating component of imprinting member 24, namely the press-plate means 34, as may perhaps best be understood by simultaneous consideration of FIGS. 3 and 4 actually in practice consists of a plurality of brick-sized panels or units, individually and collectively designated 48, the size and shape of each of which is coextensive with the size and shape of the individually simulated bricks 16 of the construction member 10. Each unit 48 is supported in a horizontally oriented fashion in facing relation to the concrete mixture 18 by appropriate connection to structural members 50 whose remote end will be understood to be operatively associated with a pressure air cylinder so that the unit 48 has a degree of simultaneous movement in opposite directions along a vertically oriented path of movement. Members 50 are projected through appropriate openings in the panel 42 (not shown) to enable the previously noted operative connection thereof to a pressure air operator 52 (see FIG. 5). When the line-forming projections 26 are urged through descending movement during a line-forming stroke and subsequently are lifted in retracting movement past the unit 48, the members 50, because of their projected relation through the panel 42, serve as guides for these vertical movements 36.

In the operation of the molding apparatus, generally designated 54 in FIG. 4, the vertical degree of movement of the two components 42 and 34, respectively, of the improved imprinting member 24 provides certain operational advantages. Among the more significant of these advantages is the fact that the imprinting member 24, following each line-imprinting operation, can be lifted clear of the concrete mass 18 thus enabling the molded concrete block or member 10 to be removed from the molding station, and another concrete mass substituted in its place. With this in mind, the previously noted support 20 for the concrete mass or mixture 18 is preferably in the specific form of a pallet which can be readily engaged by a conveyor of the like incident to feed movement 56 into and out of the molding station, as clearly illustrated in FIG. 5. The clearance space provided by lifting movement of the individual units 48 of the press-plate member 34 also supplies the necessary access to its flat surface 30 for the wiping therefrom of any adhering concrete deposits 28. Preparatory to this, of course, the line-forming projections 26 are withdrawn above the level of the surface 30.

Consistent with the embodiment of the press-plate member 34 as described herein, and which consists of the plural units 48, the previously noted line-like openings through which the projections 26 are projected and retracted during molding operation is provided by the position of adjacent pairs of units 48. More particularly, and as best illustrated in FIG. 3, taking the units specifically designated 48A and 48B as an example, these adjacent units are operatively arranged so that their side walls 38 in facing relation to each other bound an appropriate line-like opening 58 in the horizontal plane of the press-plate member 34. Since this same cooperative relation exists between other adjacent pairs of units 48, the units 48 cooperate to provide the other line-like openings 58 for accommodating the other depending line-forming projections 26.

Figure 5:
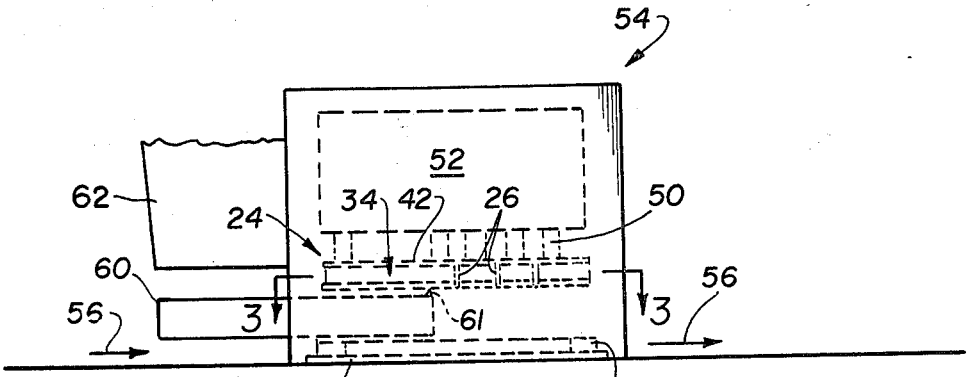

For completeness sake, the molding sequence of the molding apparatus 54 will now be described in connection with FIG. 5. The first step contemplates movement of a wooden pallet 20 into position at the molding station. Next, the mold box 22 is positioned on the pallet 20. A so-called feed drawer 60, the construction and operation of which is well known, is loaded with concrete mixture from hopper 62. The feed drawer then moves into position over the opening of the mold box 22 and meters a prescribed quantity of concrete mixture into the mold box. During this operation, vibration may be utilized to assist in flowing the concrete mixture throughout the confines of the mold box 22. After the completion of this step, the feed drawer 60 is retracted to its out-of-the-way position.

Conventional and well known techniques for preparing the concrete mixture 18 for the imprinting operations are then followed. For example, a doctor blade at this time is advantageously used to level off and smooth out the top surface 12 of the concrete mixture 18. Next, the impression molding member 34, or what is commonly known in molding parlance as a press plate which is attached to the press head, is actuated through descending movement into surface contact with the concrete mixture 18, to mold the block. Prior to this, it will be understood that the flat surface 30 is wiped clear of any portions 28 of concrete mixture which may have adhered thereto as a result of the prior molding operation.

Attached to the top of the feed drawer 60 is a squeegee 61 which wipes the face of the press plate, on both forward and return strokes. If the press plate has line forming projections as shown in FIG. 2A, then the squeegee cannot be used. Applicant's retracting projections do not interfere with operation of the squeegee 61.

The next contemplated step is descending movement 36 of the line-forming projections 26 which serve the purpose of delineating the upper surface 12 of the concrete mixture into a simulating arrangement of a plurality of individual pavers or bricks 16. Movement 36 is provided by operation of the pressure air cylinder 46 and is effective to form the line imprint 14 in the concrete mixture 18.

The next step is the retraction of the projections 26 which, as was previously explained in connection with FIG. 2, results in passage of each section 26 past the vertically oriented wall 38 of member 36 and thus in the scraping clean from each projection 26 of any adhering deposits 28 of concrete mixture.

The pressure air operator 52 then lifts both components of the improved imprinting member 24 which, as already explained, provides access for wiping removal of any deposits 28 on surface 30 of the press-plate member 34. The elevated position of the improved imprinting member 24 also facilitates clearing the molding station of the imprinted concrete mixture 18 and the movement and set up of another body of concrete mixture for imprinting. This unobstructed removal of the imprinted concrete mixture 18 also, of course, obviates any possibility that the imprinted pattern will be ruined by inadvertent contact with any wall structure or the like of the molding apparatus. In this respect it is thus an advance over molding devices, as exemplified by the device of U.S. Pat. No. 3,381,345, which embodies the imprinting member or surface as a vertically oriented side wall thereof and requires movement of the imprinted block during its removal in close proximity past this side wall. Unless precautions are taken, the imprinted block can inadvertently make contact with the side wall causing a breakage in the imprinted pattern.

Another important advantage of applicant's retracting line-forming means 26 is that it permits parallel groove walls. Prior devices required a tapered imprinting device. After the resulting "brick" block is laid, the grooves are often filled with sand to provide an attractive contrast. The prior art tapered groove failed to provide a sharp contrast as the walls of the groove appeared to the viewer as a continuation of the face of the brick. Further, the said granules are poorly retained in a tapered groove.

Applicant's resulting groove is characterized by a smooth surface. The action of the press plate in holding the molding in position while the line-forming means 26 is withdrawn is important to this result.

Although the foregoing description has been directed to the formation of simulated rectangular brick patterns, it should be understood that the term "brick" as used herein is intended to encompass regular and irregular shapes, such as stones, etc.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. An apparatus for producing a construction member of the type formed of a concrete mixture and having an imprint of lines on the surface thereof simulating an arrangement of plural individual bricks, said apparatus comprising an imprinting member consisting of a horizontally oriented panel having depending line-forming means thereon, said imprinting member being operatively arranged to be moved through a descending path projecting said depending line-forming means thereon into said surface of said concrete mixture to form said brick-simulating lines, a press-plate having a flat undersurface comprised of plural horizontally oriented cooperating units operatively mounted on vertically oriented movable supports disposed through openings in said panel of said imprinting member so as to urge said units of said press-plate member through ascending and descending movement beneath said imprinting member and above said concrete mixture along said path of movement of said imprinting member, each adjacent pair of said units being spaced apart to provide a line-like opening sized to provide wiping contact with said line-forming means during movement thereof, each said line-like opening being bounded by spaced apart walls having edges therealong effective because of said wiping contact to wipe adhering concrete from said line-forming means during the retraction of said line-forming means through a cooperating one of said line-like openings when it is moved out of imprinting contact with said concrete mixture, whereby the shaping contour of said line-forming means is maintained for subsequent imprinting service, and following which movement of said line-forming means said press-plate member is similarly adapted to be retracted clear of said concrete mixture preparatory to the unimpeded removal of said concrete mixture, and first and second pressure cylinders respectively coupled to said horizontally oriented panel with the line-forming means thereon and to said plate member to separately urge said panel and plate member through said ascending and descending movements.

2. Apparatus as claimed in claim 1 comprising a mold box having an open top disposed beneath said horizontally oriented panel, horizontally reciprocable feed drawer means movable between a feed position above the mold box for introducing concrete mixture into the mold box and a retracted position, and projecting squeegee means on said feed drawer means for wiping said flat undersurface of said press plate member as said feed drawer means moves between said feed and retracted positions.

* * * * *